United States Patent [19]

Sellers et al.

[11] 4,007,763

[45] Feb. 15, 1977

[54] NARROW FABRICS

[75] Inventors: John Sellers, Chorley; Mary Griffiths, Heywood; Thomas Harry Dyer, Manchester, all of England

[73] Assignee: Thomas French & Sons Limited, Manchester, England

[22] Filed: Mar. 20, 1975

[21] Appl. No.: 560,169

[30] Foreign Application Priority Data

Mar. 21, 1974 United Kingdom ..... 12747/74

[52] U.S. Cl. ..... 139/116; 139/387 A; 139/432

[51] Int. Cl.[2] ..... D03D 49/50; D03D 47/08; D03D 1/06

[58] Field of Search ..... 139/122 R, 124 R, 124 A, 139/387 A, 387, 20, 22, 431, 432, 116, 429, 430

[56] References Cited

UNITED STATES PATENTS

| | | | |
|---|---|---|---|
| 3,411,549 | 11/1968 | Muller | 139/432 |
| 3,529,634 | 9/1970 | Griffiths et al. | 139/22 |
| 3,665,970 | 5/1972 | Porter | 139/20 |
| 3,674,058 | 7/1972 | Sellers | 139/124 A |
| 3,741,259 | 6/1973 | Wood et al. | 139/387 A |
| 3,749,139 | 7/1973 | Rath | 139/116 X |
| 3,799,213 | 3/1974 | Wood et al. | 139/387 A |

FOREIGN PATENTS OR APPLICATIONS

| | | | |
|---|---|---|---|
| 1,302,856 | 8/1962 | France | 139/124 A |
| 2,066,756 | 6/1971 | France | 139/387 A |
| 1,221,786 | 2/1971 | United Kingdom | 139/387 A |
| 919,378 | 2/1963 | United Kingdom | 139/387 A |
| 967,967 | 8/1964 | United Kingdom | 139/387 A |
| 741,005 | 11/1955 | United Kingdom | 139/387 A |

*Primary Examiner*—James Kee Chi
*Attorney, Agent, or Firm*—James E. Nilles

[57] ABSTRACT

Method and apparatus for producing a narrow fabric, such as for example curtain heading tapes and in which one weft is of relatively stiff form and a second weft has a high coefficient of friction relative to that of the stiff weft, and wherein the stiff weft is inserted only in curtain warp sheds and the second weft is inserted only in other warp sheds.

23 Claims, 23 Drawing Figures

NARROW FABRICS

Figure 1:
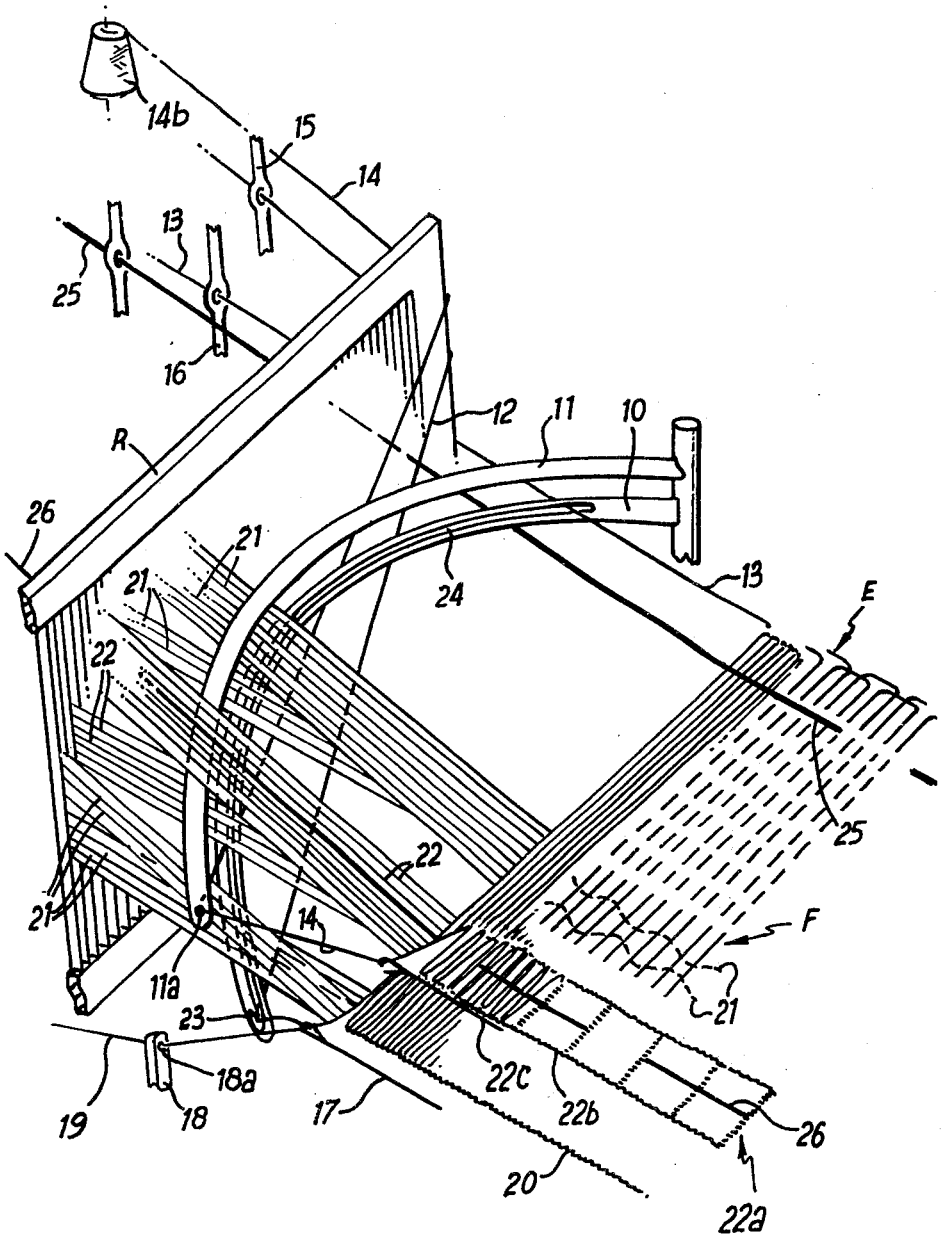
Figure 2A:
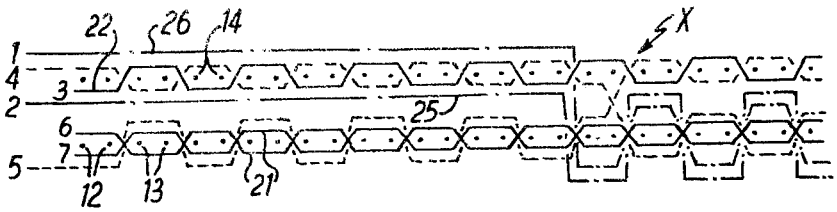
Figure 2B:
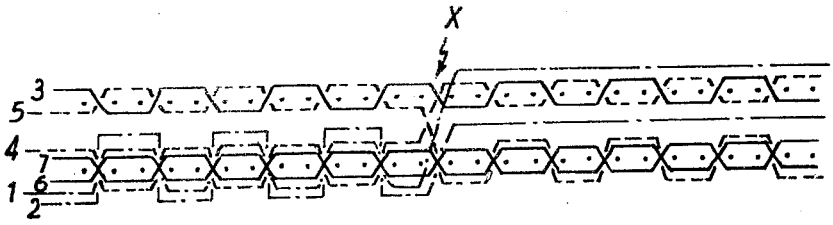
Figure 2C:
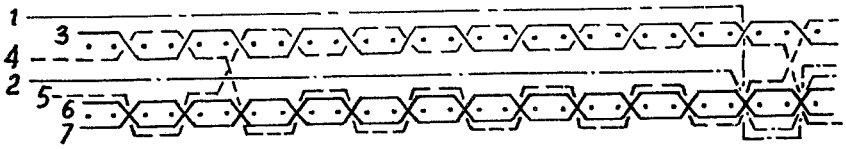
Figure 2D:
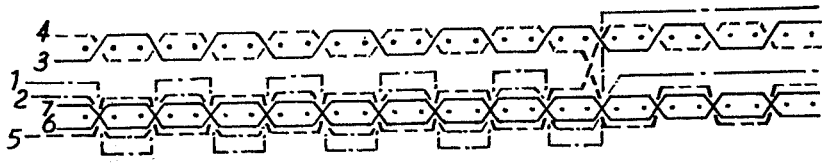
Figure 2E:
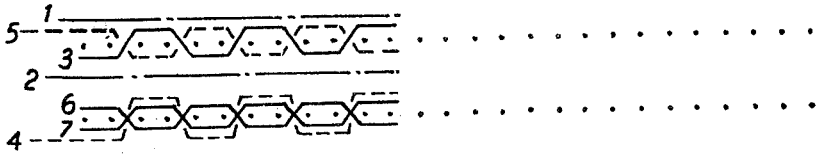

This invention concerns narrow fabrics and particularly though not exclusively narrow fabrics of the kind used as curtain heading tapes.

There are many types of narrow fabric available and it is known to produce such fabrics using natural, regenerated or synthetic yarns or mixtures thereof in the warp and/or weft depending upon the use to which the fabric is to be put.

It is also known to produce narrow fabrics on both shuttle looms and the so called needle looms in which the weft is inserted using a weft inserting needle or rapier.

In the case of curtain heading tapes in particular it is known to produce such a fabric in a form in which there is provided, for example, a body fabric and a superimposed, usually narrower, pocket forming fabric which latter is connected to the body fabric at intervals so as to form pockets which may be open at one or both ends transversely of the body fabric.

In the case in which a narrow fabric, or the body fabric of a curtain heading tape, is provided with a synthetic monofilament yarn weft only, to provide transverse stiffness in the body fabric, it has been found, due to the slippery nature of the monofilament weft, that there is a tendency for the warp to slip relative to the weft and so make the fabric unsightly. It has thus been known to provide, in addition to the synthetic yarn weft, an additional weft having a relatively much higher coefficient of friction than the monofilament yarn and thereby eliminate or at least substantially reduce the tendency for the warp to slip relative to the weft. Whilst this type of fabric, which is generally woven in two-ply form, does not have the disadvantage of a fabric having a synthetic monofilament weft only it has the disadvantage of being, generally speaking, a fabric which is bulky and expensive due to the quantity of yarn used in its manufacture.

An object of the present invention is therefore to provide a narrow fabric which has the property of being relatively stiff in the transverse direction whilst being flexible longitudinally, and which does not suffer from either of the disadvantages briefly referred to above.

It is a further object of this invention to produce a narrow fabric, being a curtain heading tape in which the body fabric does not suffer from the disadvantages briefly referred to above.

It is still further object of the present invention to produce a narrow fabric, being a curtain heading tape, which can be produced either by using a loom in which the weft is inserted using a weft inserting needle or rapier or by using a loom in which weft is inserted using a shuttle.

Thus there is provided, according to one aspect of the present invention a method of weaving a narrow fabric in which one weft is of relatively stiff form and in which a second weft has a high coefficient of friction relative to the stiff weft yarn, including the steps of inserting the stiff weft in certain warp sheds only and inserting the second weft only in other warp sheds.

In one form of the present invention the method aforesaid of weaving a narrow fabric includes the step of supplying the stiff weft from a package, initially in the warpwise direction to be drawn through selected warp sheds by a catch thread or by said second weft.

Alternatively the method of weaving a narrow fabric includes the steps of supplying both weft yarns from packages and drawing both weft yarns selectively through selected warp sheds in the form of loops.

According to another aspect of the present invention a narrow fabric made by any one of the aforesaid methods is characterised in that it is provided with a first weft of relatively stiff yarn and a second weft having a high coefficient of friction relative to the stiff yarn, the weft yarns being selectively inserted in successively formed warp sheds.

According to a still further aspect of the present invention there is provided a narrow fabric, being a curtain heading tape, in which there is provided a body fabric having a first weft of relatively stiff yarn and second weft having a high coefficient of friction relative to the stiff yarn, the yarns being selectively inserted in successively formed warp sheds and at least one pocket forming fabric including warp and weft, the pocket forming fabric or fabrics being united with the body fabric at predetermined intervals along the length of the body fabric to produce pockets capable of receiving curtain suspension hooks or the like.

Thus according to a still further aspect of the present invention there is provided apparatus for producing a narrow fabric including means for shedding warp yarns to form successive sheds, means for inserting a first weft in certain warp sheds only and means for inserting the second weft in certain other sheds only and means for beating-up the inserted wefts to form the fabric.

The invention will now be described further, by way of example only, with reference to the accompanying drawings in which:

FIG. 1. is a diagrammatic perspective view of part of one form of a curtain heading tape, made in accordance with the invention, parts of a loom being illustrated to illustrate the manner in which the fabric is woven.

FIG. 2A to E is a diagrammatic, very much enlarged, longitudinal section of the fabric of FIG. 1.

Figure 3:
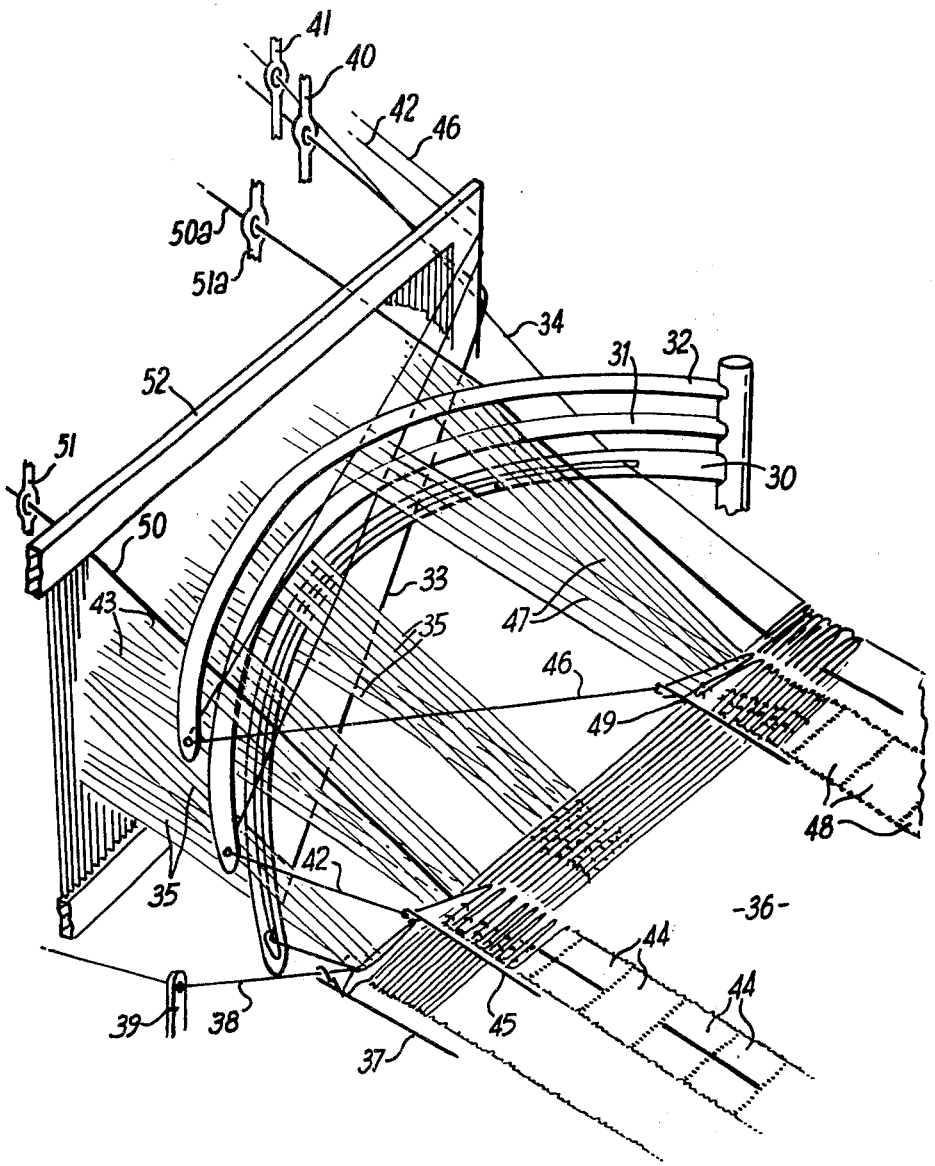

FIG. 3. is a view similar to FIG. 1. showing another form of curtain heading tape and parts of a modified form of loom.

Figure 4:
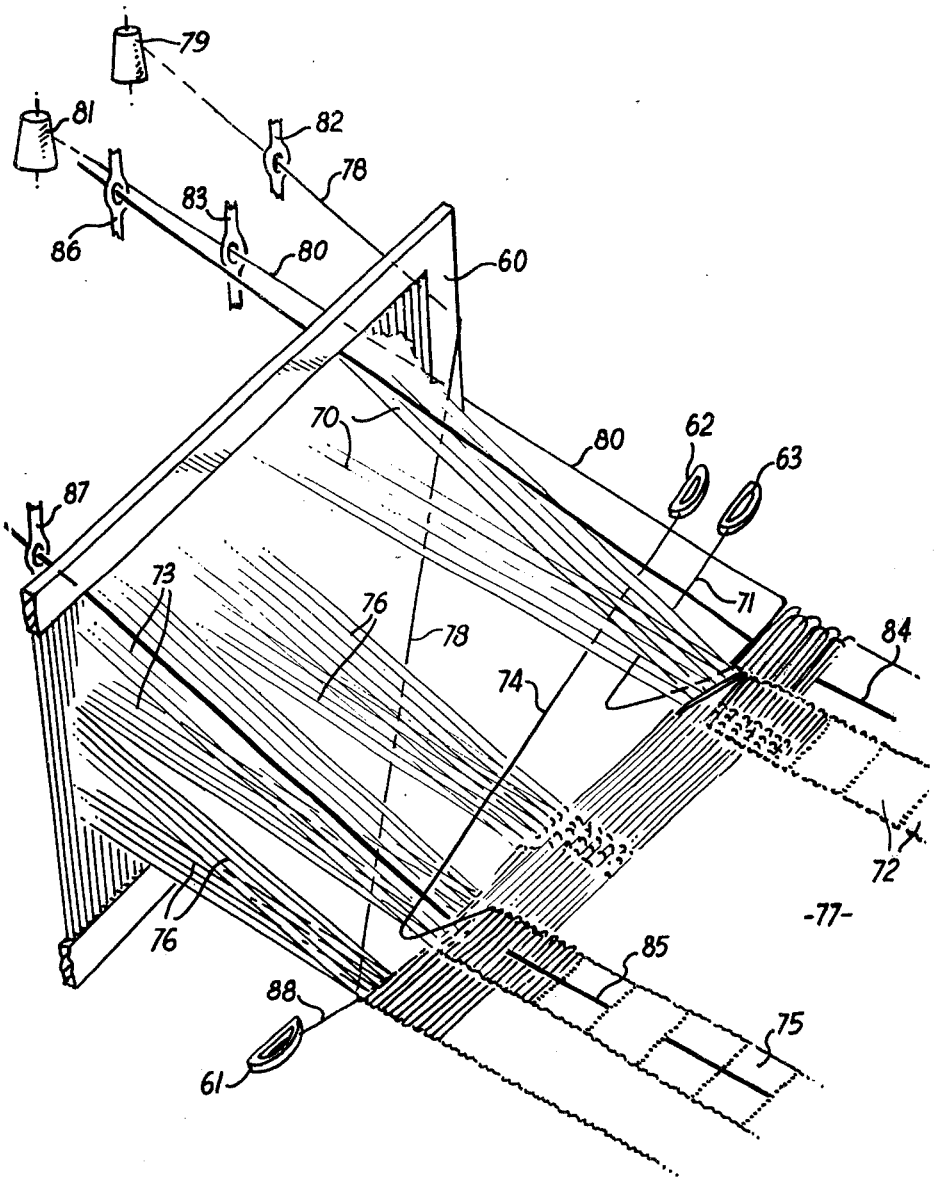

FIG. 4. is a view similar to FIG. 3. showing a still further modification of loom and part of a fabric that can be woven thereon.

Figure 5:
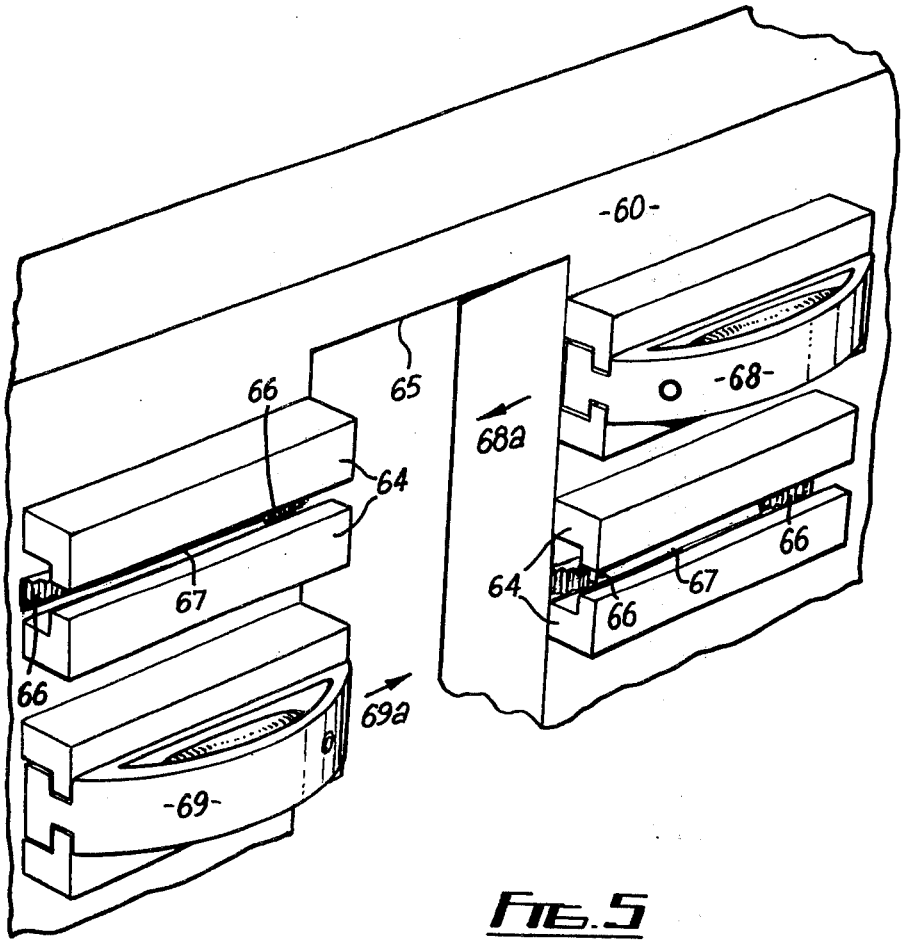
Figure 6A:
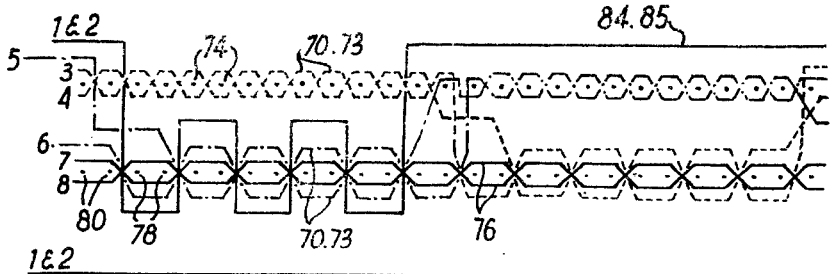
Figure 6B:
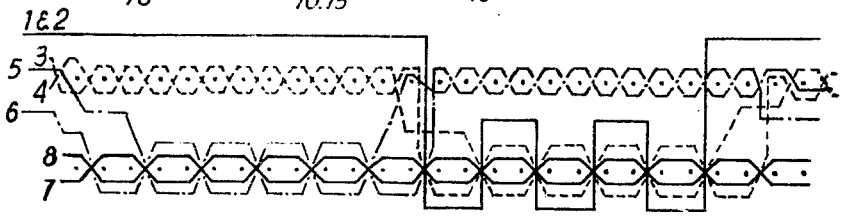
Figure 6C:
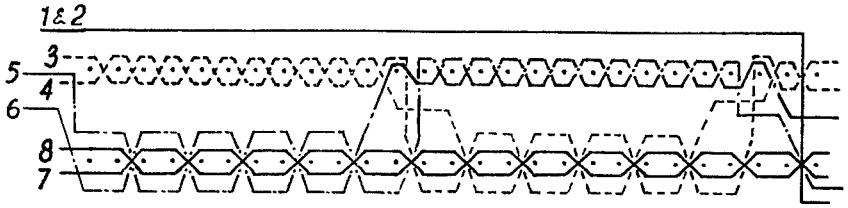
Figure 6D:
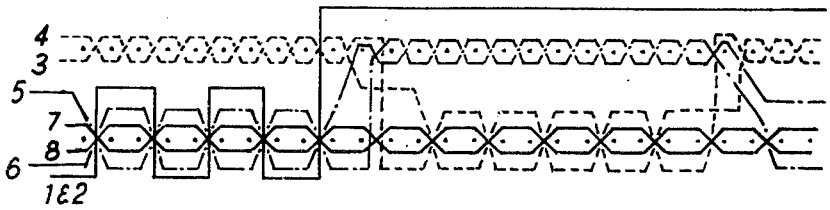
Figure 6E:
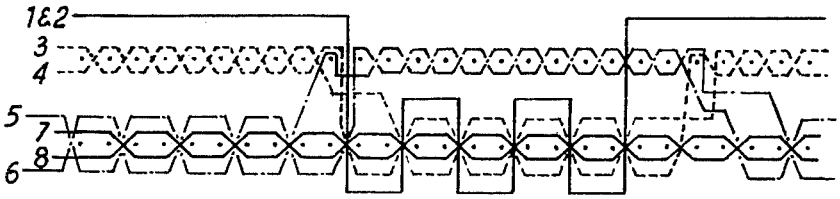
Figure 6F:
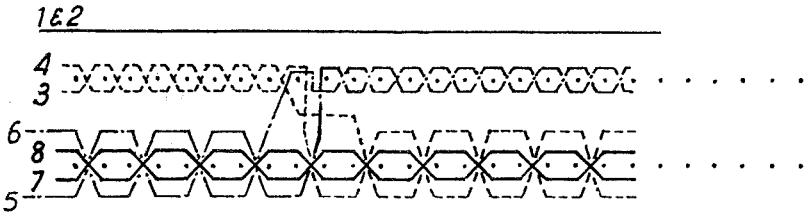

FIG. 5. is an enlarged perspective view showing a detail of the construction of the loom of FIG. 4.

FIG. 6A to F is a view similar to FIG. 2. of a fabric capable of being woven using the loom of FIG. 4.

Figure 7:
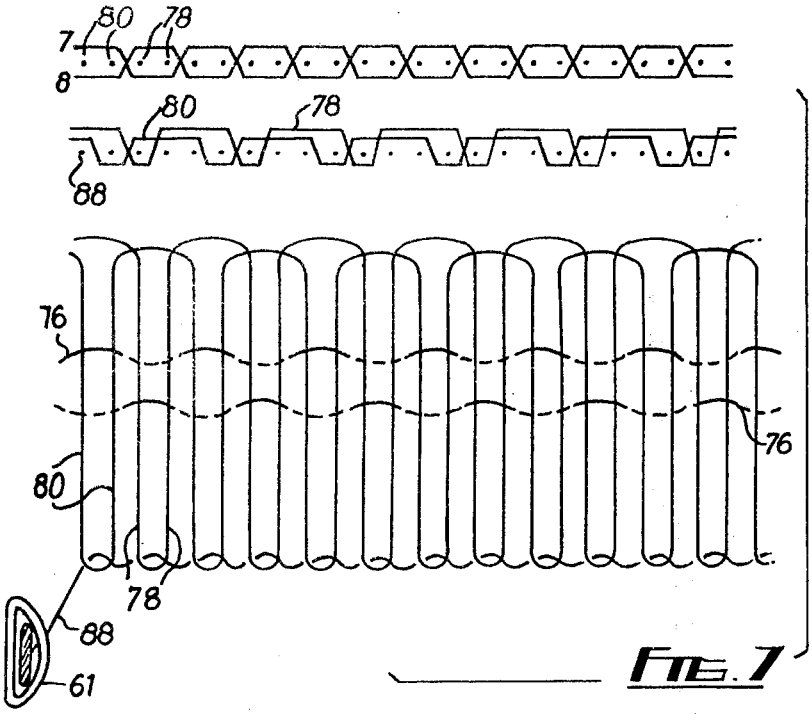

FIG. 7. are enlarged views of part of the fabric of FIG. 6. and showing how a catch thread from a shuttle is used to draw loops of warpwise oriented weft into weftwise orientation.

Figure 9:
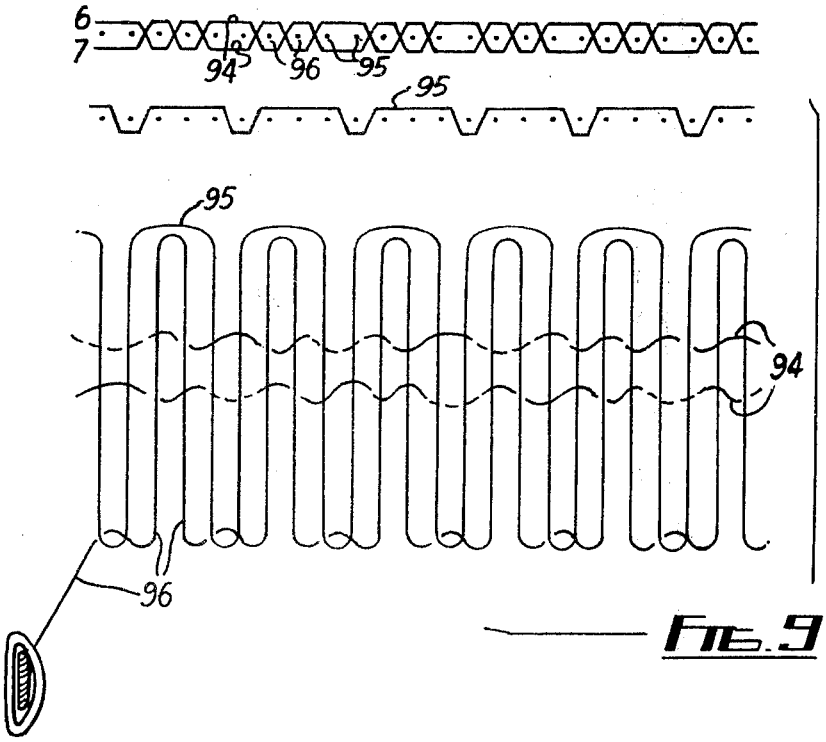
Figure 8A:
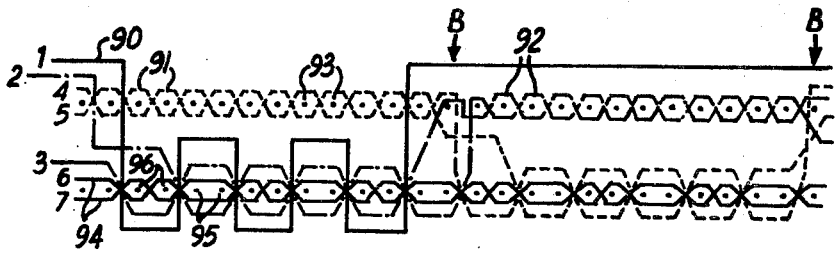
Figure 8B:
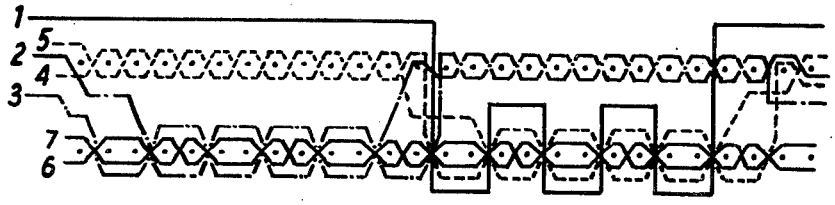
Figure 8C:
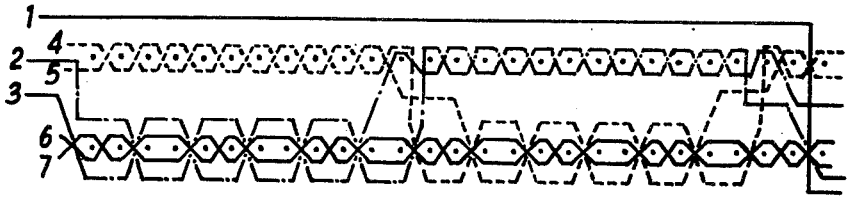
Figure 8D:
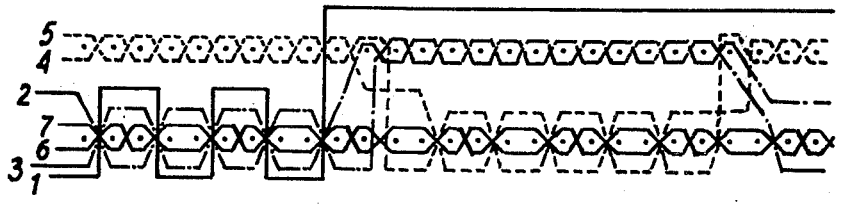
Figure 8E:
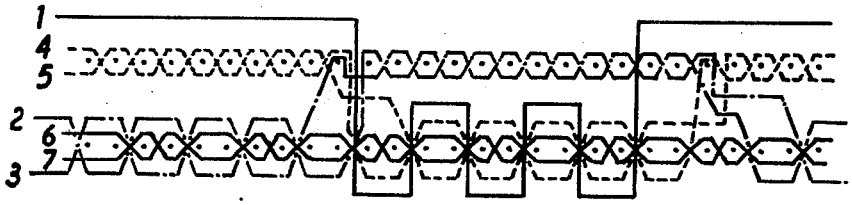
Figure 8F:
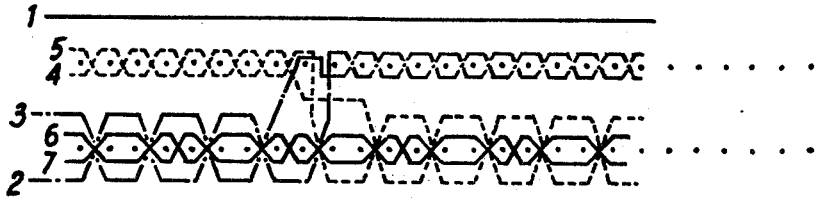

FIG. 8A to F is a view similar to FIG. 2. of a still further modification to the form of fabric that may be woven using the loom of FIG. 4. and FIG. 9. comprises enlarged views of parts of the fabric of FIG. 8. showing how a thread from a shuttle may be used as a catch thread for a warpwise oriented weft, and as a normal weft.

In the folliwng description, and in particular in relation to FIGS. 1 and 2 reference will be made to the production of a curtain heading tape using a loom provided with weft inserting needles or rapiers.

Referring now to FIG. 1. of the drawings, in which only those parts of the loom relevant to this form of the invention are illustrated it will be seen that the loom is provided with a pair of weft inserting needles or rapiers 10 and 11. The needle 10 is used to insert wefts 12 and 13 into a body fabric in alternating sequence whilst the needle 11 is used to insert a weft 14 into a superimposed, narrower, pocket forming fabric.

The wefts 12 and 13 are respectively relatively stiff yarn, for example monofilament yarn, and yarn with a high coefficient of friction relative to the stiff yarn, for example spun yarn. These two yarns are brought to the needle 10 respectively through healds 15 and 16 mounted on separate heald frames (not shown). These wefts are conveniently supplied from packages (not shown) located at the rear of the loom.

At the opposite side of the loom to the weft inserting needles 10, 11 is provided a latch needle 17, reciprocable alongside the edge of the warp, and a locking yarn feed element 18 having an eye 18a through which a locking thread 19 is supplied to the latch needle 17 to enable a knitted chain 20 of selvedge loops to be produced in known manner to retain the alternately inserted wefts 12 and 13 in position.

It should be noted that in FIG. 1. only a few of the warp yarns 21 are shown passing through a reed R in order to enable the loom parts to be seen clearly. It will also be noted that, within the body of the fabric a few weft loops and two warp yarns 21 are shown sufficiently widely spaced to show the fabric construction at F and the form of the fabric edge E at the side from which the weft inserting needles enter their warp sheds for the body and the pockets. In fact the body fabric is provided with a group of closely spaced warp yarns at each selvedge edge and a group of more widely spaced warp yarn between the selvedges. As can also be seen on FIG. 1. there is a single row 22*a* of pockets formed by the warp yarns 22 and the weft 14.

As can also be seen from FIG. 1. the weft inserting needle 11 is of well known form, having a single eye 11*a* at its free end through which the weft 14 of the pocket forming fabric passes. This weft 14 is supplied from a package 14*b* at the rear of the loom. The other weft inserting needle 10 serves however to insert alternately the monofilament weft 12 and the spun weft 13. To achieve this the needle 10 is provided with a weft inserting eye 23 at its free end and a slot 24 running along its length, the slot 24 joins the eye 23 so that in use, with one weft in the eye 23 insertion of that yarn through the warp shed formed by warp yarns 21 can take place whilst the other weft is located in the slot 24 to allow the needle to move without causing insertion of the weft located in the slot; such a weft inserting needle is known as a 'slip sickle' weft inserter. In the position shown the next weft to be inserted will be spun weft 13 which latter will become located in the eye 23 after the weft inserter has been retracted from the warp shed formed by warp yarns 21 and the healds 15 and 16 have been shed.

Shedding of the healds 15, 16 serves to locate either the weft 12 or 13 in the eye 23 whilst the other weft 13 or 12 is located in the slot 24. Weft becomes located in the eye 23 when a heald is raised and alternatively becomes located in the slot 24 when the heald is lowered.

Conveniently the warp of both the body fabric and the narrower fabric are shed in a 1 and 1 manner so that the resultant tape has plain weave form, the wefts all being inserted in the form of loops to produce double picks.

A latch needle 22*c* is provided to produce a knitted chain selvedge 22*b* along the edge of the narrower fabric 22. In this case, however, no locking thread is used the chain being formed by knitting loops of weft 14 one through the other is known manner.

Pleating cords 25 and 26 of appreciably greater diameter than the warp yarns are provided warpwise along the length of the tape, one of these cords, 25 is bound into the body fabric and the other, 26, is bound into the pocket forming fabric and the body forming fabric. The exact manner of binding in the pleating cords 25 and 26 is not shown in FIG. 1. but can be seen in FIG. 2.

If desired a further cord (not shown) like a pleating cord in that it is of appreciably greater diameter than the warp yarns, can be located along the knitted selvedge edge of the body fabric to ensure that the ends of the loops of the monofilament weft 12 are substantially indiscernible.

A curtain heading tape produced in accordance with the description set out above (and illustrated in FIG. 2. yet to be referred to) can, due to the fact that it is of single-ply construction and due to the fact that the warp shed is changed such as to provide a warp crossover between each double pick, be woven using relatively widely spaced warp yarns 21 across a substantial part of the body fabric with the weft yarn loops relatively widely spaced so that a fabric can be produced which is of appreciably less bulk than the many curtain heading tapes which incorporate both spun yarn weft and monofilament yarn weft in the body and certainly of very much less bulk than a two-ply fabric having monofilament weft and spun weft. It is in fact estimated that a saving of about one third of the usually employed warp ends can be made, as compared to the warp yarns used in a two-ply fabric, and that in the woven tape an approximate overall weight saving of about 35% can be achieved, again as compared to a two-ply fabric.

Turning now to FIG. 2. which shows one pattern repeat for the tape of FIG. 1. it is seen that the tape can be woven on a loom having seven shafts (excluding those used for shedding the weft yarns 12 and 13 as they are fed to the weft insertng needle 10).

In the arrangement shown the shafts are used as follows:

SHAFT 1. for pleating cord 26.
SHAFT 2. for pleating cord 25.
SHAFT 3. for warp 22 used only in the pocket forming fabric.
SHAFTS 4 and 5. for warp yarns woven alternately in the body fabric and the pocket forming fabric.
SHAFTS 6 and 7. for warp 21 woven only in the body fabric.

As can be seen the weft yarns 12, 13 are used in a lower shed and the weft yarn 14 is used in an upper shed, that is to say the tape is woven with the pocket forming fabric on the upper face (in the loom) of the body fabric. It should also be noted that each weft is indicated by a pair of dots, each pair of which represents a loop of weft, that is to say each pair of which represents a double pick of weft.

Turning now to the shedding of the seven shafts and dealing with each shaft in turn it will be seen that pleating cord 26 of shaft 1 floats over the pocket forming fabric of the tape for nineteen consecutive double picks and is then woven with the body wefts for eleven double picks. The pleating cord 25 of shaft 2 floats over the body fabric for the same nineteen double picks and is then woven with the body fabric during the next eleven double picks.

The bound in portions of the pleating cords 25 and 26 are thus aligned transversely of the tape.

The pocket warps 22 of shaft 3 are woven wholly with the pocket weft 14 along the length of the tape and are shed in a 1 and 1 configuration (since there is a shed change after each double pick) in this pocket forming fabric.

The warp of shaft 4 is woven in a 1 and 1 configuration (since there is a shed change after each double pick), alternately for nine double picks with the warp of shaft 3 and then for nine double picks with the warp of shaft 6, that is for nine double picks with the pocket forming weft 14 and nine double picks with the body forming wefts 12 and 13.

The warp of shaft 5 weaves for nine double picks with the body forming wefts 12 and 13 (whilst the warp of shaft 4 weaves with the pocket forming weft 14) and then for nine double picks with the pocket forming weft 14 (whilst the warp of shaft 4 weaves with the body forming wefts 12 and 13).

As can be seen the bind in of the warps of shafts 4 and 5 is at the cross over positions X of these warps from the body fabric into the pocket forming fabric and vice versa.

The warps of shafts 6 and 7 weave continuously with the body forming wefts 12 and 13 in a 1 and 1 configuration (since there is a shed change after each double) along the length of the tape. There are warps on shaft 6 and 7 across the whole width of the body fabric. At the selvedges the warps of shafts 6 and 7 are more closely packed than is the case across the remainder of the width of the fabric.

Turning now to FIGS. 3 and 4 and initially to FIG. 3. it will be seen that there is provided a loom for producing two parallel longitudinally disposed spaced-apart rows of pockets on a body fabric.

As can be seen the loom for producing this fabric is provided with three weft inserting needles or rapiers, 30, 31 and 32. The needle 30 is of the slip sickle type and is used to insert weft yarns 33 and 34 into sheds formed from warp yarns 35 which are used to produce a body fabric 36. A latch needle 37 is provided to knit a catch thread 38 through loops of weft yarns 33, 34 at the selvedge opposite to that from which the needle 30 enters the warp sheds. A catch thread guide 39 is provided for the catch thread 38. The weft 33 is conveniently stiff monofilament yarn and the weft 34 is conveniently spun yarn. Healds 40 and 41 serve respectively to shed the weft yarns 33 and 34 so as selectively to enter one or other yarn into the eye of the slip sickel 30. The needle 31 serves to insert a weft yarn 42 into a warp shed formed by warp yarns 43 to produce a row of pockets 44 adjacent the edge of the body 36 having the catch thread knitted selvedge. A latch needle 45 is provided to produce a knitted selvedge along the pockets 44 by knitting successively inserted loops of weft 42 in known manner.

The apparatus so far described will produce a fabric identical to that described in relation to the apparatus of FIG. 1.

The third needle 32 serves to insert a weft 46 into the sheds formed by a group of warp yarns 47 to produce a row of pockets 48 adjacent the opposite edge of the body fabric 36.

A third latch needle 49 serves to produce a knitted edge for the pockets 48 by knitting successively inserted loops of weft 46 in known manner.

As can be seen two draw cords 50 and **50*a* are provided. These are shed independently by healds 51 and 51*a* respectively to enable them to be bound into the fabric at transversely aligned positions. Two healds 51 and 51*a* are conveniently used since the lift of the draw cord 50 is greater than that of the draw cord 50*a*. The lift of the draw cord 50 must be sufficient to raise that cord above the level of the needle 31, since the draw cord is located above and below the pockets 44 whereas the draw cord 50*a* requires only to be lifted above the needle 30 since it is located in the body 36 of the fabric alongside the pockets 48. If desired both of the healds 51, 51*a* could be located on the same shaft, in this case the eye of the heald 51 would be higher than that of heald 51*a***.

A loom reed 52 serves to beat-up the wefts 33, 34, 42 and 46 during weaving of the fabric.

The loom is provided with heald frames (not shown) which serve to split the total warp sheet into three groups namely a lower group comprising the body warp yarns 35, an intermediate group comprising the warp yarns 43 for pockets 44 and an upper group comprising the warp yarns 47 for pockets 48.

As in FIG. 1. only some of the warp yarns are shown for the sake of clarity. Again as in the construction of the fabric of FIGS. 1 and 2 the body fabric is provided with a group of closely spaced warp yarns 35 at each selvedge and a group of more widely spaced warp yarns between the selvedges. Also as in the case of the fabric of FIGS. 1 and 2 the weft is inserted in loops, that is in double pick form with a shed change after each double pick insertion thus the body fabric 36 and the pockets 44 and 48 are woven with a 1 and 1 configuration.

To weave a fabric having two rows of pockets a loom having nine shafts for warp yarns is required together with two additional shafts, that is one each for the healds 40 and 41 which shed the weft yarns 33 and 34 inserted in the body 36 of the fabric by the slip sickle weft inserter 30. The weaving pattern used is like that of FIG. 2 with the extra two shafts carrying the warp yarns for the pockets 48 being shed like those used to carry the warp yarns for the pockets 44.

By increasing the number of weft inserting needles or rapiers additional rows of pockets can be woven if desired. For example, by using a slip sickle weft inserter and three additional needles or rapiers three rows of pockets could be produced. Additional shafts to provide different lift for the pocket forming warp yarns would of course be required, together with an additional latch needle to knit the edge of the additional row of pockets.

A fabric like that produced by the loop of FIG. 3. can also be produced using a narrow fabric loom equipped with shuttles. Such a loom is shown, in so far as its parts essential to the carrying into effect of the invention is shown diagrammatically in FIG. 4. of the drawings.

Referring now to FIG. 4. of the drawings it will be seen that the loom is provided with a read 60 and three shuttles 61, 62 and 63. The shuttles are mounted one above the other and, in fact, since the loom is of substantially standard construction there would be four shuttles, one of which is not shown since it is not used. In a standard narrow fabric loom the shuttles operate in pairs and move in opposite directions during each pick insertion; FIG. 5. illustrates diagrammatically part of the standard arrangement of shuttle and operating mechanism of a narrow fabric loom. As can be seen the reed 60 serves to carry vertically disposed pairs of shuttle guide rails 64 at each side of an opening 64 in which reed bars (not shown) are located. Drive pinions 66 project through slots 67 formed in the reed 60 at each pair of guide rails 64. The pinions are driven from drive shaft means (not shown). The drive means is such that as shuttle 68 moves across the opening 65 in the direction of arrow 68*a* shuttle 69 moves across the opening 65 in the direction of arrow 69*a*. Thus providing there are four pairs of shuttle guide rails on the reed 60 of the loom of FIG. 4. shuttle 61 can move oppositely to shuttles 62 and 63 by locating shuttle 61 in the lowest pair of guide rails and by locating shuttles 62 and 63 respectively in the next upper pair of guide rails and the top pair of guide rails.

In the loom of FIG. 4. there are heald frames (not shown) for shedding a group of warp yarns 70 which weave with a weft 71 of shuttle 63 to form a row of pockets 72 adjacent one edge of the fabric; heald frames (not shown) for shedding a group of warp yarns 73 which weave with a weft 74 of shuttle 62 to form a row of pockets 75 adjacent the other edge of the fabric. In addition there are heald frames (not shown) for shedding a group of warp yarns 76 which are to be woven with two different types of weft (hereinafter referred to) to form a body fabric 77. The two wefts which weave with the warp yarns 76 conveniently comprise a monofilament weft 78 supplied from a package 79 at the rear of the loom and a spun yarn weft 80, also fed from a package 81 located at the rear of the loom. The weft 78 as can be seen from FIG. 4. is initially fed warpwise through a heald 82 and similarly the weft 80 is fed initially warpwise through a heald 83. Draw cords 84 and 85 are provided these being woven respectively through the body 77 only, adjacent the pockets 72, and through the body 77 and pockets 75. The draw cords are shed by healds 86 and 87 respectively, in order that their lifts can be controlled individually or by healds controlled by a single heald frame, in which case the eye of the heald 87 is positioned to give greater lift than that of the heald 86. The difference in lift is required since cord 85 overlies the pockets 75 whereas the cord 84 overlies the body 77 only.

To draw the body wefts 78 and 80 into sheds formed by the warp yarns 76 the shuttle 61 is provided with a catch thread 88. Conveniently the wefts 78 and 80 are drawn through successive warp sheds in alternating sequence as will be explained below in relation to the weaving diagrams of FIGS. 6 and 7. If desired, of course, a different sequence of weft insertion can be used dependent upon the shedding pattern of healds 82 and 83. Whatever the shedding sequence of healds 82 and 83 loops of weft are drawn through the warp sheds of warp yarns 76.

To weave the fabric of FIGS. 6 and 7 the loom requires eight shafts, excluding those used to shed the healds 82 and 83 which shed the wefts 78 and 80.

The shafts are used as follows:

SHAFTS 1 and 2. for shedding the draw cords 84 and 85. The draw cords are in face shed to provide transversely aligned floating portions on the opposite faces of the fabric. Two shafts being conveniently used to cater for the difference in lift required for the cords 84 and 85 as explained above.

SHAFTS 3.4.5. and 6 for shedding warp yarns 70 and 73 for forming the pocket fabric of pockets 72 and 75.

SHAFTS 7 and 8 for shedding warp yarns 76 for forming the body fabric 77.

As can be seen from FIG. 6. the warp yarns 76 weave continuously with the weft yarns 78 and 80 in a 1 and 1 configuration, that is to say there is a shed change after each double pick insertion. The wefts 71 and 74 of the pockets weave with the warps 70, 73 in true 1 and 1 manner, that is to say only single picks of weft are inserted between each shed change. The pocket width is of twelve pick width, that is twelve picks of the wefts 71, 74 and the bind in of the pocket warps with the body is over two double picks. To form the pockets commencing at the left hand side of FIG. 6A the warps of shafts 3 and 4 weave with the weft 70, 73 (that is pockets 72 and 75 are being woven simultaneously using the same shed changes for the warps 70 and 73 but with different lifts) and at the first pick the warp of shaft 6 lies below the weft 70, 73 and the warp of shaft 5 lies above the weft.

During the weaving of the pocket with warps 70, 73 of shafts 3 and 4 the warp 70, 73 of shafts 5 and 6 is being woven with the body warps of shafts 7 and 8. At the termination of the pocket woven with shafts 3 and 4 the warps of shafts 5 and 6 are shed to weave 1 and 1 with the wefts 70, 73 for twelve picks and the warp of shaft 3 and 4 weave with the warps of shafts 7 and 8. It follows, therefore, that the warps of shafts 3 and 4 are used to weave alternate pockets 72 and 75 and the warps of shafts 5 and 6 are used to weave intermediate pockets 72 and 75. The draw cords 84 and 85 are so shed as to lie on the pocketed face of the body 77 over two pocket widths and on the unpocketed face over one pocket width.

Turning now to FIG. 7. which serves to illustrate the manner in which the wefts 78 and 80 are drawn into the warp sheds in loop form it will be seen that in the first shed there is a loop of weft 80. To achieve this the shuttle 61 has moved across the warp shed of warps 76 with the heald 83 raised, the yarn of shuttle 61 serves as a catch thread and at the first traverse across the warp shed it lies, as can be seen, below the warpwise oriented weft 80. The heald 83 is now located and thus when the shuttle 61 moves back through a changed warp shed the catch thread is looped around the weft 80 and thus draws a loop thereof through the warp shed of warp 76. The warp shed changes and the positions of healds 82 and 83 are reversed so that as the shuttle 61 now passes through the shed of warp 76 it lies under the warpwise oriented weft 80 and over the warpwise oriented weft 78. The shed of warps 76 changes, the heald 83 remains in position and the position of heald 82 changes. The shuttle moves through the new shed formed by warp 76 and now draws a loop of weft 78 with it but due to the weft 80 having remained above the catch thread 88 no loop of weft 80 is drawn. The shed changes for warp 76, the shuttle 61 moves across the shed. The shed of warp 76 changes, the position of heald 82 remains unchanged and the position of heald 83 changes to cause the catch thread now to draw a loop of weft 80 through the shed of warp 76 and so the cycle repeats. Thus to produce loops alternatively of weft 80 and 78 the shedding of these wefts by healds 83 and 82 is in a 3 and 1 manner. As weaving proceeds the catch thread becomes located along the selvedge of the body fabric thus locking the loops of weft 80 and 78 against movement.

To produce a fabric with only one row of pockets, say pockets 75, all that is necessary is to omit warp yarns 70 and shuttle 63.

A single ply body fabric 77 is thus produced with alternating loops of stiff weft and loops of yarn having a high coefficient of friction with a shed change between each loop. This construction of body fabric, due to the presence of the high coefficient of friction weft and the shed change between each weft loop ensures that the fabric is stable, that is the warp cannot slip relative to the stiff weft.

The loom of FIG. 4. when used to produce a single row of pockets is provided with seven shafts for shedding warp yarns and draw cords and in addition a shaft for controlling the stiff weft yarn.

The manner in which the fabric is woven is illustrated in FIGS. 8 and 9. Turning to FIGS. 8 and 9 it will be seen that the arrangement of shafts is as follows:

SHAFT 1. for draw cords 90.

SHAFTS 2.3.4. and 5. for warp yarns 91 and 92 used to weave, with a weft yarn 93, pocket forming fabric.

SHAFTS 6 and 7. for warp yarns 94 used to weave a body forming fabric with a stiff yarn 95 supplied from a package, and a yarn 96 with a much higher coefficient of friction.

The warp yarns 94 are shed continuously in a 1 and 1 configuration so that there is a shed change after each weft insertion, the weft 95 which is, as in the loom of FIG. 4. drawn through a warp shed in loop form (see FIG. 9 in particular). In contradistinction to the loom of FIG. 4. however the catch thread used to draw this loop of weft 95 through a warp shed of warp 94 is also used as weft and produces two single picks between each loop of weft 95, as can be seen most clearly in FIG. 9. The warp yarns 91 weave alternate pockets with the weft yarn 93 and the warp yarns 92 weave intermediate pockets with the weft yarn 93. Thus as shown in FIG. 8. warp yarns 91 weave with the weft yarn 93 for fourteen consecutive picks with weft yarn 93 in a true 1 and 1 manner to produce a pocket of twelve picks width and during the weaving of this pocket the warp yarns 92 weave with the wefts 95 and 96 in the body of the fabric. The warp 92 then weaves for fourteen picks with the weft 93 to produce a pocket of twelve picks width and during the weaving of this pocket the warp 91 weaves with the wefts 95 and 96 in the body of the fabric. As can be seen the warps 91 and 92 cross from the pocket to the body and vice versa during two picks of the weft 93 at pocket bind-in positions B so that the pocket fabric becomes joined to the body fabric at equi-spaced intervals along the length of the fabric.

Turning now particularly to FIG. 9. which shows only body warp yarns 94 and wefts 95 and 96 it will be seen that to insert a loop of weft 95 the shuttle, carrying weft 96, has traversed the shed while the warpwise oriented weft 95 is raised by its shaft so that the weft 96 passes below the weft 95. The shed now changes and the weft 95 is lowered by its shaft, the weft 95 now passes through the new shed and loops around the weft 95 to draw a loop thereof through the shed. The shed changes, the shaft carrying weft 95 is raised, the shuttle carrying weft 96 now passes through the shed to insert a single pick, after a shed change, the shuttle carrying weft 96 passes back to its original position to insert another single pick of weft. The shed changes, with the shaft carrying weft 95 remaining stationary, the shuttle carrying the weft 96 passes across the shed to lie below the weft 95, which latter has been held above the weft 96 for the preceding three picks due to its shaft remaining stationary. The shed changes, the shaft carrying weft 95 is lowered, the shuttle passes back across the shed and due to the shed change of the shaft carrying weft 95 a loop of this weft is inserted. This cycle of operations repeats as the body fabric is being woven.

The shedding of shaft 1 for the draw cords 90 is such that the draw cords lie on the pocketed face of the fabric for two pocket widths and is woven with the body of the fabric for one pocket width.

As can be seen, particularly in FIG. 9. the shaft carrying the weft 95 is shed in a 3 and 1 manner.

The invention is not restricted to the details set out above. For example, the weave for the body fabric and the pocket forming fabric may be other than 1 and 1 configuration and the pleating cords can be bound in at spacing other than that described. Additionally the pocket width and the one pick cross over of pocket warp of shafts to cause bind-in with the body weft can be altered if desired to make wider or narrower pockets than those described with a bind in of more than one pick between pockets. It should also be appreciated that by modifying the shedding of the warpwise oriented weft or wefts sequences of weft insertion other than those referred to above can be achieved.

It is also possible to produce an unpocketed single ply fabric by simply omitting the warp and weft yarns used to produce the pockets. Such a fabric can be used, for example, in clothing manufacture as a stiffening fabric.

In the preceding description reference has been made to the use of a monofilament yarn as the stiff weft, and to the use of spun yarn as the weft for the pockets and in the body. It is, of course, possible to use multifilament yarn as the stiff weft if desired, or, in fact, to use the so called core yarn as the stiff weft or as a replacement for the spun yarn. Core yarn comprises a monofilament or multifilament yarn with a spirally wrapped yarn or yarns therearound.

By the 'stiff' in relation to weft yarn we mean a yarn which will return to its original form after bending. Thus yarn such as monofilament or multifilament nylon, polyester yarn, acrylic monofilament or multifilament yarn, polyvinylidene yarn, or the like, fall within the meaning of this term. As to the diameter of the yarn this will largely be dependent upon the number of picks/inch and the width of the fabric. By the term 'high coefficient of friction' in relation to weft yarn we mean a yarn which has a very substantially higher coefficient of friction, than, for example, a monofilament nylon yarn. Thus spun yarn, bulked yarn and the like, due to its inherently rough surface and due to its deformability under pressure which results in its ability to bed into other yarns at their intersections, that is at the intersections between warp and weft, fall within the meaning of this term.

We claim:

1. The method of weaving a narrow fabric having a first weft of relatively stiff form, a second weft which has a high coefficient of friction relative to said first weft, and a multiplicity of warp yarns, including the steps of creating a shed, inserting a weft into said shed, beating-up the inserted weft, changing the shed and inserting a successive weft, beating-up the said successive weft, and repeating the steps to produce a woven fabric, the said weft insertion steps comprising inserting said first weft in certain warp sheds only and said second weft only in the other warp sheds, the said warp sheds being successively formed in the same plane thereby to enable said first and said second wefts to be contained in a common single weft plane in the fabric.

2. A method of weaving a narrow fabric as claimed in claim 1 including the steps of supplying the stiff weft from a package, initially in the warpwise direction to be drawn through selected warp sheds by a catch thread or said second weft.

3. A method of weaving a narrow fabric as claimed in claim 1 including the steps of supplying both weft yarns from packages and drawing both weft yarns selectively through selected warp sheds in the form of loops.

4. A method of weaving a narrow fabric as claimed in claim 1 including the step of drawing the stiff weft and the second weft selectively through selected warp sheds by a single catch thread.

5. A method of weaving a narrow fabric as claimed in claim 1 including the steps of inserting the stiff weft and the second weft in selected sheds by means of a weft inserting needle, shedding the stiff weft and second weft selectively to locate one only of the stiff weft or the second weft in a hood means of said weft inserting needle for insertion in a warp shed and simultaneously positioning, by the said shedding, the other weft in a slot of the needle to prevent insertion in said warp shed.

6. A method of weaving a narrow fabric as claimed in claim 1 including the step of supplying a locking thread to a knitting means reciprocable alongside that edge of the fabric opposite to that from which the stiff weft and the second weft are inserted in selected sheds and knitting the locking thread through loops of stiff weft and second weft inserted in said selected warp sheds.

7. A method of weaving a narrow fabric as claimed in claim 1 including the step of passing a catch thread through successively formed warp sheds from one side of a fabric being woven, shedding a stiff weft and a second weft at the opposite side of the fabric being woven, by means independent of each other and independent of the means for forming successive warp sheds, so shedding the stiff weft and the second weft to cause one only thereof to be looped at any one time by said catch thread and drawing the so looped weft through a warp shed in loop form, and selectively shedding the stiff weft and the second weft as to draw loops thereof through successively formed warp sheds in pre-determined sequence.

8. A method of weaving a narrow fabric as claimed in claim 7 including the step of inserting the stiff weft and the second weft through alternate warp sheds.

9. A method of weaving a narrow fabric as claimed in claim 1 including the step of inserting the stiff weft and the second weft through alternate warp sheds.

10. A method of weaving a narrow fabric as claimed in claim 1 including the step of supplying the stiff weft from a package, initially in the warpwise direction, and the second weft by a shuttle, said second weft being inserted in single pick form in at least two successive warp sheds and serving as a catch thread to draw a loop of said stiff weft through another warp shed.

11. A method of weaving a narrow fabric as claimed in claim 10 including the step of inserting the second weft in single pick form through two successive warp sheds and using said second weft as a catch thread in the next successive shed to draw a loop of the stiff weft therethrough.

12. A method of weaving a pocketed curtain heading tape in the form of a narrow fabric as claimed in claim 1 comprising a body fabric, and at least one narrower fabric secured thereto, including the step of inserting at least one further weft thread through successively formed sheds of at least one further group of warp yarns to produce at least one narrower fabric and periodically shedding some of the warp yarns of said further group or groups with the warp yarns of the body fabric to unite the narrower fabric or fabrics with the body fabric at predetermined positions lengthwise of the body fabric thereby to produce at least one longitudinal row of open-ended pockets along said body fabric.

13. A method of weaving a narrow fabric as claimed in claim 12 including the step of supplying two further groups of warp yarns and two further weft threads thereby to produce two longitudinal rows of open-ended pockets along said body fabric.

14. A method of weaving a narrow fabric as claimed in claim 12 including the step of inserting the at least one further weft in the form of loops through the further at least one group of warp yarns by means of a weft inserting needle for each said further weft, and providing a knitting means for each further group of warp yarns to knit loops of weft through each other at that edge of each narrower fabric opposite to that form which the loops are inserted.

15. A method of weaving a narrow fabric as claimed in claim 12 including the step of inserting at least one further weft through successively formed sheds of at least one further group of warp yarns to produce at least one narrower fabric and periodically shedding some of the warp yarns of the said at least one further group with the warp yarns of the body fabric to unite each narrower fabric with the body fabric at predetermined positions lengthwise of the body fabric thereby to produce at least one row of open-ended pockets along said body fabric.

16. A method of weaving a narrow fabric as claimed in claim 15 including the step of supplying two further groups of warp yarns and two further weft threads using two further shuttles thereby to produce two longitudinal rows of open-ended pockets along said body fabric.

17. The method of weaving a narrow fabric as claimed in claim 1 including the step of supplying, as the stiff weft, a synthetic monofilament yarn and as the second weft a spun yarn.

18. Apparatus for producing a narrow fabric including heald frames for shedding warp yarns, supply means for a stiff weft and a means for shedding said stiff weft, a reed, means for guiding same said stiff weft warpwise to a position forwardly of said reed, supply means and shedding means for a second weft means for shedding said second weft and guiding same warpwise to a position forwardly of said reed characterised in that there is provided a slip sickle weft inserter (as herinbefore defined) adapted to insert the said stiff weft and the second weft in predetermined sequence in different warp sheds formed by said warp shedding means.

19. Apparatus for producing a narrow fabric as claimed in claim 18 including at least one additional supply means and means for shedding at least one further weft and guiding same warpwise to a position forwardly of said reed, characterised in that there is provided an additional weft inserter for each further weft.

20. Apparatus for producing a narrow fabric including heald frames for shedding warp yarns, supply means for a stiff weft, means for shedding said stiff weft, a reed, means for guiding said stiff weft warpwise to a position forwardly of said reed, supply means for a second weft, means for shedding said second weft and guiding same warpwise to a position forwardly of said reed, characterised in that a shuttle is provided for carrying a catch thread adapted selectively to draw weft loops of said stiff weft and said second weft through successive warp sheds.

21. Apparatus as claimed in claim 20 including at least one additional shuttle means for shedding selected warp yarns to form at least one additional shuttle to enable a pocketed curtain heading tape to be produced.

22. Apparatus for producing a narrow fabric including heald frames for shedding warp yarns, supply means for a stiff weft, means for shedding said stiff weft, a reed, means for guiding said stiff weft warpwise to a position forwardly of said reed, and a shuttle adapted to carry a yarn which selectively acts as a catch thread and as the second weft.

23. Apparatus as claimed in claim 22 including at least one additional shuttle means for shedding selected warp yarns to form at least one additional shed for said at least one additional shuttle to enable a pocketed curtain heading tape to be produced.

* * * * *